US005230682A

United States Patent [19]

Myers

[11] Patent Number: 5,230,682

[45] Date of Patent: Jul. 27, 1993

[54] EXERCISE DEVICE

[76] Inventor: Marguerite J. Myers, 12623 Hametown Rd., Doylestown, Ohio 44230

[21] Appl. No.: 708,760

[22] Filed: May 29, 1991

[51] Int. Cl.[5] ..... A63B 21/02

[52] U.S. Cl. ..... 482/122; 273/413

[58] Field of Search ..... 482/122, 124, 121, 126; 446/486, 490; 273/200 R, 413, 26 A, 29 A, 185 C, 200, 319

[56] References Cited

U.S. PATENT DOCUMENTS

| | | | |
|---|---|---|---|
| 1,646,122 | 10/1927 | Tidwell | 273/413 |
| 3,069,162 | 3/1962 | Samuel | 272/79 |
| 4,830,366 | 5/1989 | Ruden | 482/122 |

FOREIGN PATENT DOCUMENTS

| | | | |
|---|---|---|---|
| 0688151 | 2/1953 | United Kingdom | 273/413 |

*Primary Examiner*—Stephen R. Crow

*Attorney, Agent, or Firm*—Oldham, Oldham & Wilson Co.

[57] ABSTRACT

This invention is a novel exercise device, for use in either aerobic, anaerobic (i.e. muscle strengthening), proprioception activities, or aquatic exercises, which is capable of exercising opposing muscle groups in sequence using one apparatus. The device comprises a tensioning device which is used to resist elongation, thereby exercising one set of muscles, and a compressible device which is used to resist compression, thereby exercising the opposing set of muscles. Additionally, this device is constructed with an optional set of supplemental safety loops or handles which can be used in operation which will minimize the potential of the apparatus to slip off a users' limb when in the elongated position, thereby recoiling with potential injury to the participant.

7 Claims, 3 Drawing Sheets

EXERCISE DEVICE

TECHNICAL FIELD

The present invention relates to an exercise device, for use primarily in conjunction with aerobic, anaerobic (i.e. muscle strengthening), proprioception activities, or aquatic exercises, which is capable of exercising opposing muscle groups in sequence using one apparatus.

BACKGROUND OF THE INVENTION

This invention relates to an improved exercise device for one person which will exercise opposing muscle groups sequentially, and is available for year-round use. This multi-functional device is capable of being used in both terrestrial and aquatic environments. The aquatic environment is particularly advantageous when the user requires a low-impact workout, such as would be the case when physical therapy may be prescribed to rehabilitate a muscle group, or a set of muscle groups.

Traditional exercise equipment typically exercises only one set of muscles during utilization of the apparatus. This is illustrated by the use of resilient "rubber-band" like exercisers. This approach is effective in exercising a given set of muscles, such as the chest muscle group (e.g. pectoralis major) when grasping the device by the hands, but is not useful in exercising the opposing back muscle set (e.g. infraspinatus, teres minor, teres major, and rhomboideus major), in this exâmple.

Since physical exertion occurs only when elongating the device, the period of time during which the device is returning to its normal "relaxed" state, is non-productive from an exercise standpoint, unless the participant uses force to prevent the rapid natural contraction of the device. Even when this is done, the exertion only benefits the contracted set of muscles. The opposing muscles, which can be exercised only by performing an operation requiring exertion in an opposite direction, such as an exertion requiring compression, are not used.

One approach to alternately exercising different sets of muscles is illustrated in U.S. Pat. No. 4,830,366. In this configuration, a central accordion-like compression member is linked via a nut and bolt configuration, to elastic tension members which provide resistance to an elongation force. The user straps the device to a pair of limbs using an inelastic strap with bayonet-type clasps.

SUMMARY OF THE INVENTION

The present invention, generally stated, provides an improved exercise device for use in either aerobic, anaerobic (i.e. muscle strengthening), proprioception activities or aquatic exercises, which is capable of exercising opposing muscle groups in sequence using one apparatus. This is achieved by capitalizing on the amount of exercise accomplished by elongating a component of the apparatus, and then additionally requiring the participant to expend additional energy in compressing another component of the apparatus.

It is a further object of this invention to design an exercise device which is inexpensive to manufacture and easy to use. Unlike previous exercise devices, this system provides the user with a totally flexible system, thereby minimizing the amount of chafing which may occur during exercising if significant amounts of hard plastic or metal were present.

It is a still further object of this invention to design an exercise device which is safe to the user and minimizes the potential for the device slipping off a user's limb and potentially seriously injuring the participant by the recoil of the device from its elongated position without the need to resort to a complicated clamping mechanism.

DETAILED DESCRIPTION OF THE INVENTION

Figure 1:
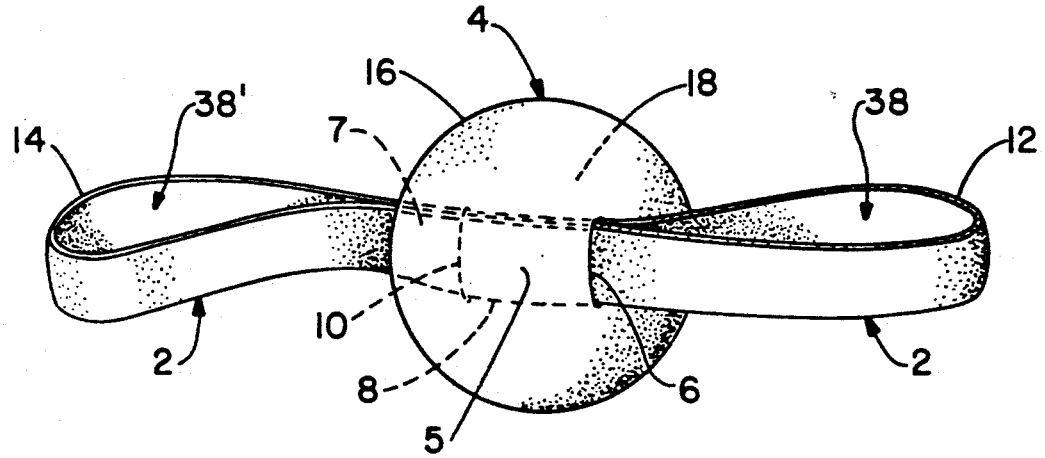
FIG. 1 illustrates a perspective view of the exercise device when using a slit configuration in the compressible member with the looped tension member passing through the slit.

This invention will be described in detail with reference to the preferred embodiment thereof. Like elements are identified by like reference numerals throughout the drawings and specification.

FIG. 1 represents a first embodiment of the invention. In this configuration, tension means 2 has first end segment 12, second end segment 14, middle segment 8 and is disposed through ingress slit 6 and egress slit 10 which is contained within interior 18 of compressible member 4. The material of construction of tension means 2 can be quite varied, but must possess the inherent characteristics of being capable of elongation, and yet be resilient enough to return to its original size and shape when the elongation force is removed. Another way to state this property, is that the material has a "memory". One material of construction would be an elastomeric polymer. One such commercially available product is DYNA-BAND TM, available from The Hygenic Corporation, Akron, Ohio.

Tension means 2 is a continuous loop, either by specific manufacture, or formed by mechanically joining the ends of a single band by any known technique (e.g. knotting, clamping, or adhesive means).

In order to meet the varying needs, goals and aspirations of generations of exercise participants, it is necessary to provide the tension means with varying degrees of resistance. By providing this flexibility, the exercise device can be used by all generations of users.

In actual operation, a user would insert one limb through loop hole 38 and another limb through loop hole 38'. By exerting an elongation force against first and second end segments 12,14, resilient tension means 2 is expanded outward. Subsequent to maximum elongation, which is dependent upon the strength of the individual user, the elongation force is removed and the user now directs attention to applying a compressive force to exterior surface 16 of compressible member 4. By exerting a compressive force at both first contact area 5 and second contact area 7, the user is now exercising the opposing muscle set utilized when elongating the exercise device. This described method of operation is applicable to all embodiments of the invention enumerated below.

Compressible member 4 can be constructed out of a wide range of materials, but must possess the inherent characteristics of being capable of compression, and yet be resilient enough to repeatedly return to its original size and shape when the compressive force is removed. Another way to state this property, is that the material has a "memory". One material of construction would be a foamed elastomeric polymer. Compressible member 4 will typically have a substantial portion of void space within its interior. It is these void spaces which permit a user to compress the object. Alternatively, inflatable compressible members are also contemplated.

Through repetitive elongation and compression manipulations of the exercise device, and utilizing all combinations of the four limb extremities, the user will accomplish a total body workout. By the totally flexible design, there is no hard plastic or metal components which have the potential to chafe the skin of the user during a vigorous workout, thereby permitting the user to utilize the device for longer periods of time comfortably.

Figure 2:
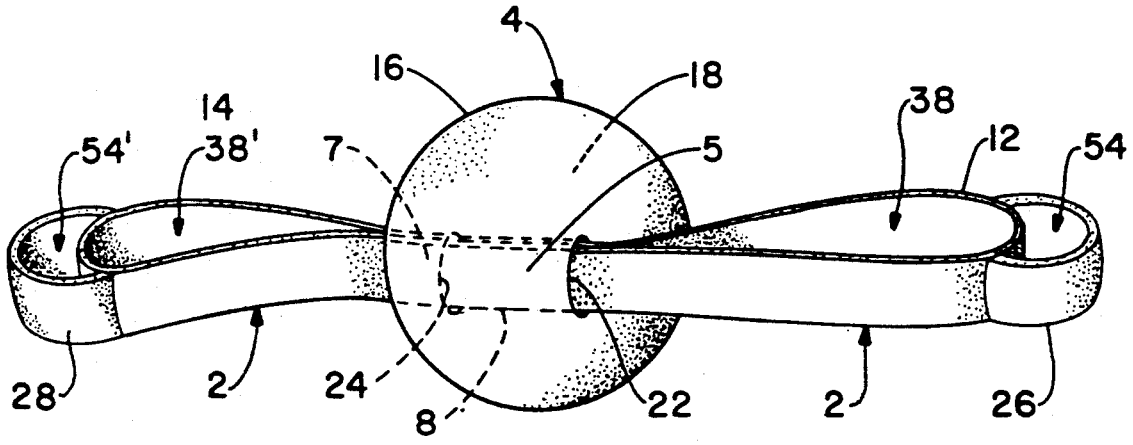
FIG. 2 illustrates a perspective view of the exercise device when using a hole configuration in the compressible member with the looped tension member passing through the hole, with optional safety feature.

FIG. 2 is a second embodiment of the invention. In this configuration, ingress slit 6 and egress slit 10 are replaced by ingress hole 22 and egress hole 24. The range of motion used with this apparatus could be identical to that described for the first embodiment. An additional optional safety feature has been added to this device. It should be recognized that this safety feature could be incorporated into any of the embodiments of the exercise devices shown, and the omission of this supplemental device is not to be construed that it is unusable in certain embodiments.

Supplemental first safety member 26 has been added to first tension end segment 12 with corresponding supplemental second safety member 28 added to second tension end segment 14. Safety loops 54,54' now assume the functions which had been described for loop holes 38,38'. The benefit of using safety loops 54,54' lies in their decreased size in comparison to loops 38,38'. It is much more difficult for the exercise device to slip off a user's limb when used in this safety-conscious manner. Alternatively, these supplemental safety members could be a handle, not shown.

Figure 3:
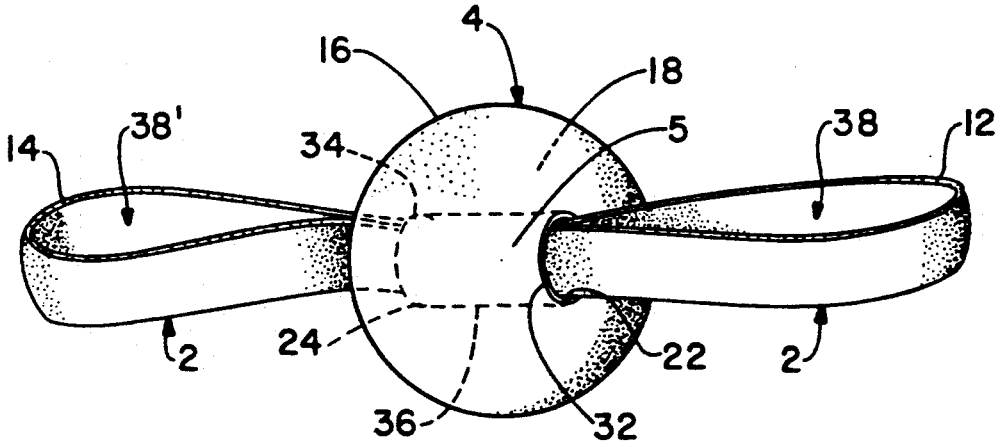
FIG. 3 illustrates a perspective view of the exercise device when using a supplemental sleeve in the hole configuration in the compressible member with the looped tension member passing through the sleeve.

FIG. 3 represents a third embodiment of this invention. It builds on the second embodiment and incorporates frictionally fitted tubular sleeve 36, around the hole created by ingress hole 22 and egress hole 24. When used in this configuration, compressible member 4 has a decreased tendency to tear at the extremities of holes 22,24. Tubular sleeve 36 is compressible in both a radial and a longitudinal direction.

In an alternative arrangement, but serving the same function, i.e., the prevention of tearing which may occur at ingress hole 22, egress hole 24, or ingress slit 6, egress slit 10, can be prevented by using a flexible washer (not shown) around the holes or slits. This flexible washer can be adhered to the surface of compressible member 4 at contact areas 5,7 by techniques well known in the art (e.g. adhesives).

Figure 4:
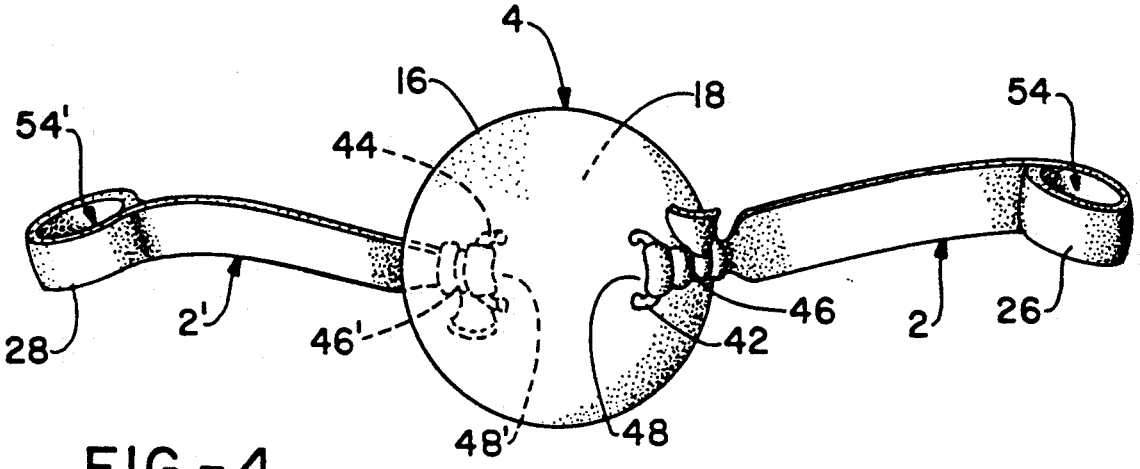
FIG. 4 illustrates a perspective view of the exercise device when using a handled attachment arrangement in the compressible member with the tension member attaching to the handle.

FIG. 4 represents a fourth embodiment of the invention. This configuration differs from the previous embodiments in several respects. First, a plurality of tension means 2 are now utilized in the device. In this arrangement, and through the employment of attachment points 42,44 located inside or outside compressible member 4, with attachment holes 48,48' the plurality of tension means 2,2' are fitted through attachment holes 48,48' and secured with end-tying means 46,46' (e.g. a knot). Optional supplemental safety loops have been added in this embodiment as was the case in the second embodiment.

Figure 5:
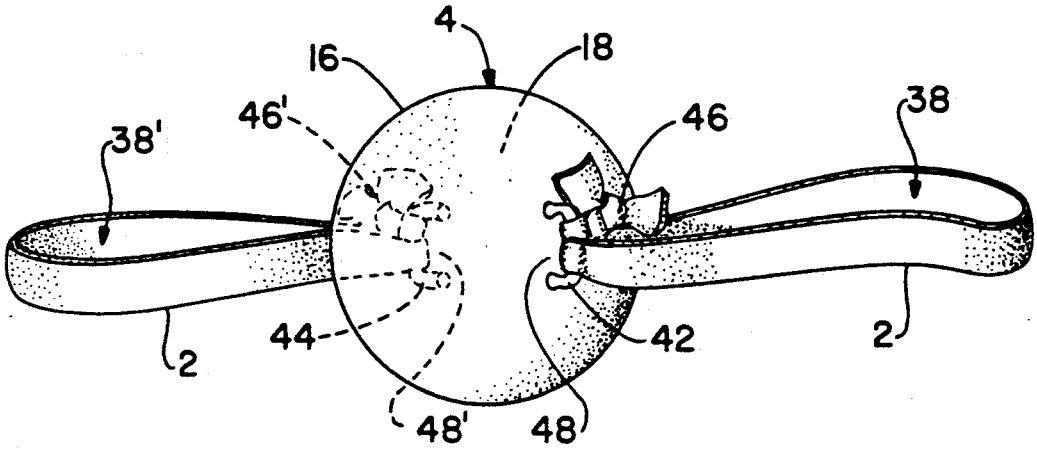
FIG. 5 illustrates a perspective view of the exercise device when using a handled attachment arrangement in the compressible member with the tension member in a looped configuration through the handle.

FIG. 5 represents yet a fifth embodiment of the invention building on the fourth embodiment. The salient distinction is tying knots 46,46' in such a manner so as to form loops 38,38'. It should be recognized that employing the device in this manner will require a significantly longer length for tension means 2.

Figure 6:
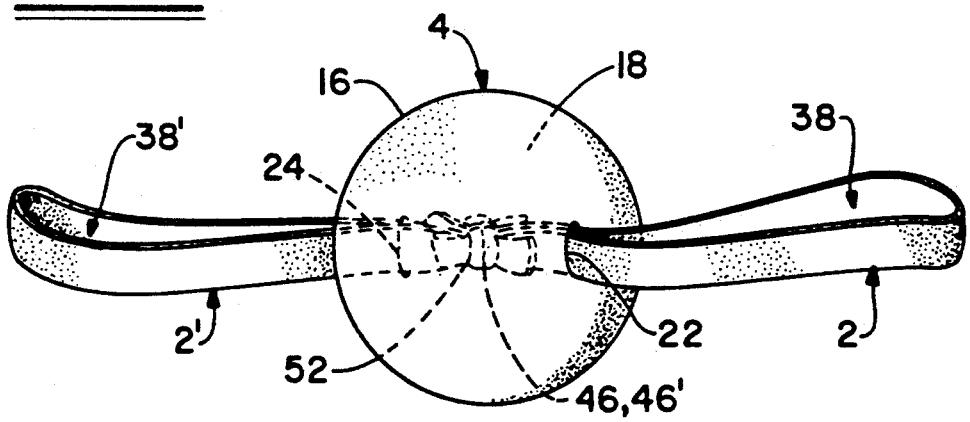
FIG. 6 illustrates a perspective view of the exercise device when using a hole through the compressible member with the tension member in a double-looped configuration.

FIG. 6 is a sixth embodiment of the invention. It represents looped arrangement 52 whereby crossing tension means 2,2' prior to tying knots 46,46' so as to create loops 38,38', now represents an additional attachment means linking compressible member 4 with tension means 2,2'. In the figure, ingress hole 22 and egress hole 24 are shown, however it is equally likely to use the device employing ingress slit 6 and egress slit 10 as illustrated in FIG. 1, or by using tubular sleeve 36 as illustrated in FIG. 3.

Figure 7:
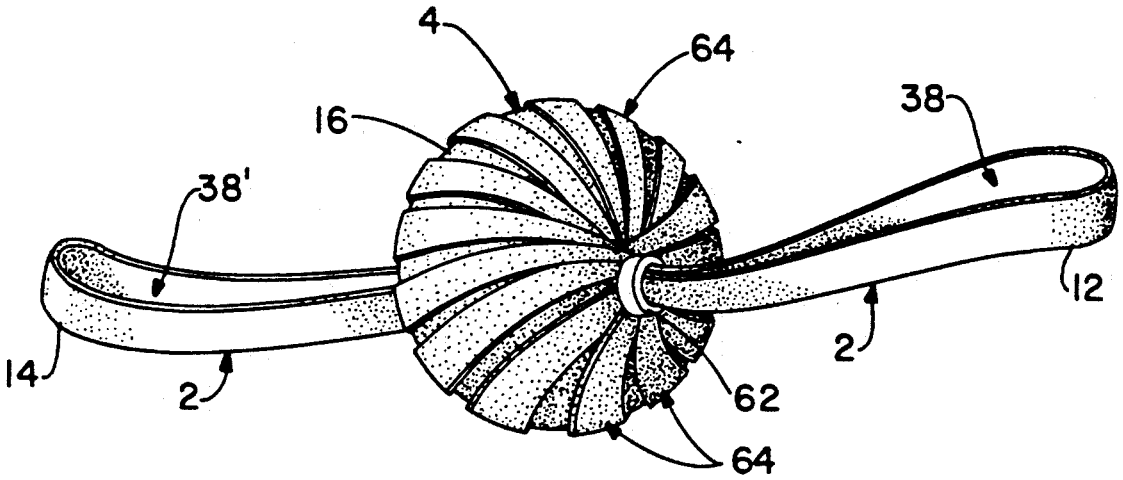
FIG. 7 illustrates a perspective view of the exercise device when using a wrapped pattern of the tension member around the exterior surface of the compressible member.

FIG. 7 represents a seventh embodiment of the invention. This configuration eliminates the potential for wear and tear on compressible member 4. Tension means 2 is employed in wrapping pattern 64 over exterior 16 of compressible member 4. Tension means 2 is secured to compressible member 4 at first contact area 5 and second contact area 7 by binding means 62. These binding means can be as simple as a knot or can be a pair of rings which frictionally fit over tension means 2.

While in accordance with the patent statutes, the best mode and preferred embodiment of the invention have been described, it is to be understood that the invention is not limited thereto, but rather is to be measured by the scope and spirit of the appended claims.

What is claimed is:

1. An exercise device comprising:

(a) a resilient flexible elastomeric ribbon-like tension means, said tension means having a first end segment, a second end segment and a middle segment, said first end and second end segments being so adapted as to form two loops by said first and second end segments with said middle segment, to permit easy insertion and removal of a user's extremities into said loops, said tension means at said first and second ends additionally having a sufficient contact area upon said user's extremities by a width of said ribbon-like tension means to minimize the potential for the first and second ends to slip off the user's extremities and injure the user by a recoil of the first and second ends; and (b) a compressible member with an exterior surface and an interior surface, said exterior surface having a first and a second contact area, each contact area situated such that the surfaces are positioned on opposing sides of said compressible member, said compressible member additionally having a radially disposed slit therethrough from said first contact area to said second contact area thereby frictionally engaging the middle segment of the tension means, a user's extremities being in contact with the first and second contact area during a compression component of an exercise, and not in contact with the first and second contact area during an elongation component of the exercise, said first and second looped ends being opposite each contact area, said middle segment of the tension means emanating from the compressible member in an axis normal to the first and second contact areas, and further wherein said compressible member and tension means operate independently during elongation and compression components of exercise.

2. The exercise device of claim 1 wherein the first end segment and second end segment of the tension means have a safety attachment means securely attached to said ends.

3. The exercise device of claim 2 wherein the safety attachment means is a handle.

4. The exercise device of claim 2 wherein the safety attachment means is a flexible resilient tensioning material, capable of accepting a human limb.

5. The exercise device of claim 1 wherein the compressible member is weighted.

6. The exercise device of claim 1 wherein the tension means is made ribbon-like by connecting the first and second end segments together.

7. The exercise device of claim 1 wherein the tension means is an elastomeric rubber.

* * * * *